United States Patent [19]

Beasley et al.

[11] 3,930,802

[45] Jan. 6, 1976

[54] INDUSTRIAL WASTE GAS INCINERATOR

[76] Inventors: Albert W. Beasley, 11417 Seagoville Road; James Clark, 11409 Seagoville Road, both of Mesquite, Tex. 75149

[22] Filed: Sept. 16, 1974

[21] Appl. No.: 506,493

[52] U.S. Cl...... 23/277 C; 55/DIG. 20; 55/DIG. 30; 110/8 A; 431/5; 431/202

[51] Int. Cl.[2]..... F23G 7/06

[58] Field of Search...23/277 C; 55/DIG. 20, DIG. 30; 110/8 A; 431/5, 202

[56] References Cited

UNITED STATES PATENTS

| | | | |
|---|---|---|---|
| 3,289,729 | 12/1966 | Reed | 431/202 |
| 3,560,165 | 2/1971 | Beasley | 431/5 |
| 3,702,756 | 11/1972 | Bowman | 23/277 C |
| 3,808,987 | 5/1974 | Ehrliehmann | 110/8 A |

*Primary Examiner*—James H. Tayman, Jr.
*Attorney, Agent, or Firm*—Robert K. Rhea

[57] ABSTRACT

An upright generally cylindrical casing forms a gas passageway communicating with the exhaust of a flue for receiving its heated exhaust gases. A burner, axially mounted below the casing in the heated gas stream, heats the gases and refractory material contained by the casing to a combustion temperature. Baffles in the casing direct the heated gases toward refractory vanes contained by the casing. Additional air is admitted to the depending end of the casing to support combustion of unburned hydrocarbons.

2 Claims, 4 Drawing Figures

INDUSTRIAL WASTE GAS INCINERATOR

BACKGROUND OF THE INVENTION

1. Field of the Invention

The present invention relates to afterburners and more particularly to an upright secondary incinerator for use with primary combustion devices, such as incinerators or industrial flues.

Air pollution has become a major health problem in most larger metropolitan areas primarily as a result of inefficient burning of fuel or waste in primary combustion chambers. This inefficient burning results in large quantities of hydrocarbons suspended in the exhaust gases or smoke as well as larger particles which remains suspended in the atmosphere and in some instances settles out on buildings, or the like, in the form of soot. Various attempts have been made to eliminate this air pollution such as by utilizing an electrostatic type smoke eliminator for large flues which are intended to remove particles of carbon from the smoke stream, however, such devices are relatively expensive and require frequent maintenance to maintain their efficiency. Other attempts have been made to provide secondary burners to continue the combustion of exhaust gases but these devices, for the most part, have not been generally accepted. One of the reasons being that to attain efficient burning of exhaust gases it is necessary that the temperature of the gases be elevated to a combustion temperature and mixed with additional air to initiate and continue the afterburning.

This invention provides a novel smoke stream heating means including a combustion chamber supplied with a large quantity of additional combustion air which is added to the smoke stream as it moves through the combustion chamber.

2. Description of the Prior Art

The most pertinent prior patent is U.S. Pat. No. 3,560,165.

The principal distinction of this invention over this patent is the manner of increasing the temperature of flue gases to a combustion temperature while adding additional air to support combustion in combination with refractory material maintaining combustion.

SUMMARY OF THE INVENTION

An upright elongated generally cylindrical casing is placed with its depending end in communication with the outlet of a flue. The depending end portion of the casing is axially provided with a refractory cylinder having an overlying vertical fin supported refractory baffle radially deflecting heated gases entering the casing toward the refractory cylinder. A burner, axially disposed below the casing heats exhaust gases from the flue which, in turn, heats the refractory material to a combustion temperature while additional air is supplied to the heated gases by perimeter openings in the depending end and wall portion of the casing. After the refractory material reaches a combustion temperature continued burning of the waste gases is self-generating. Screen means, mounted on the uppermost end of the casing, traps fly ash and the like.

The principal object of this invention is to provide afterburner means for initiating and maintaining the burning of unburned hydrocarbons in suspension in a smoke stream in a self sustaining action.

BRIEF DESCRIPTION OF THE DRAWINGS

FIG. 1 is a perspective view of the incinerator in operative position on a smoke flue, or the like.

DESCRIPTION OF THE PREFERRED EMBODIMENT

Figure 2:
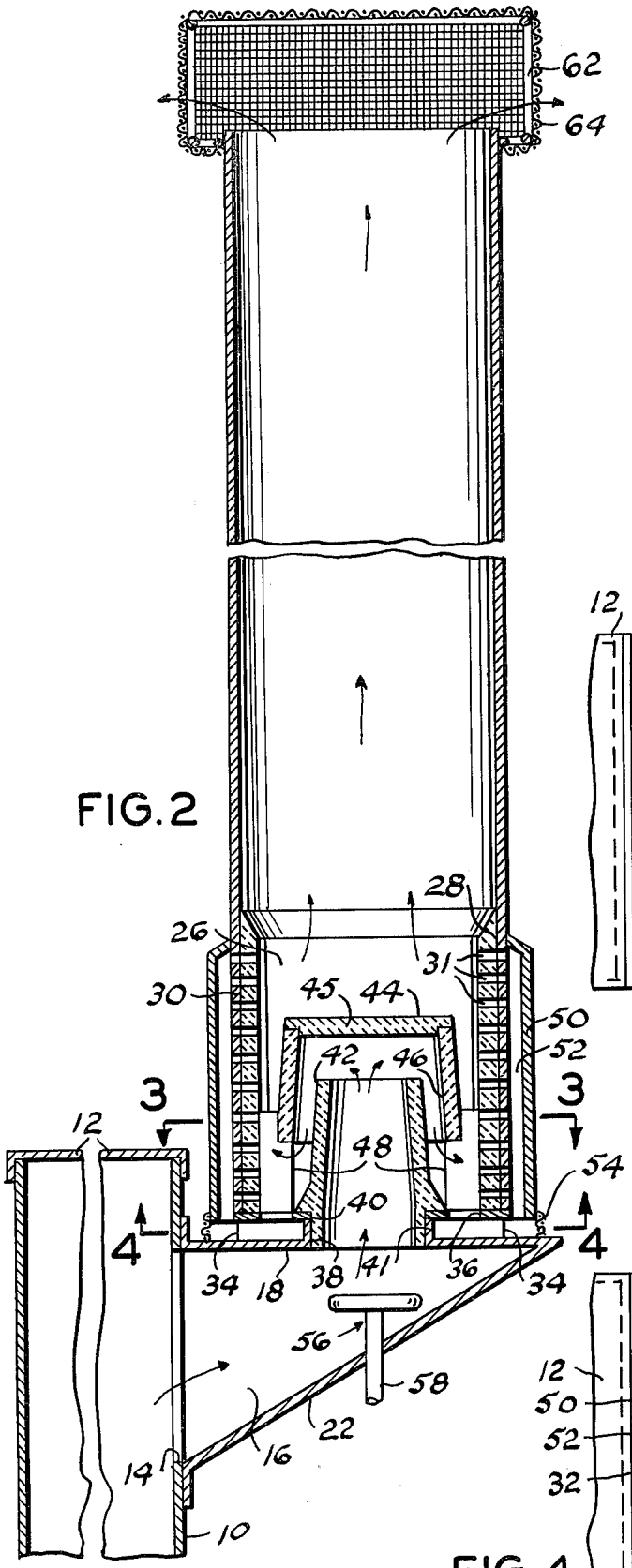
FIG. 2 is a vertical cross sectional view, to an enlarged scale, taken substantially along the line 2—2 of FIG. 1; and, FIGS. 3 and 4 are horizontal cross sectional views taken substantially along the lines 3—3 and 4—4 of FIG. 2.
Figure 1:
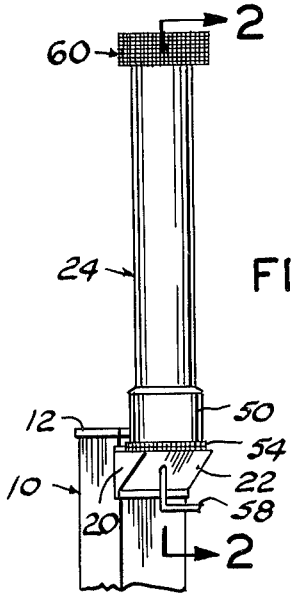
Figure 3:
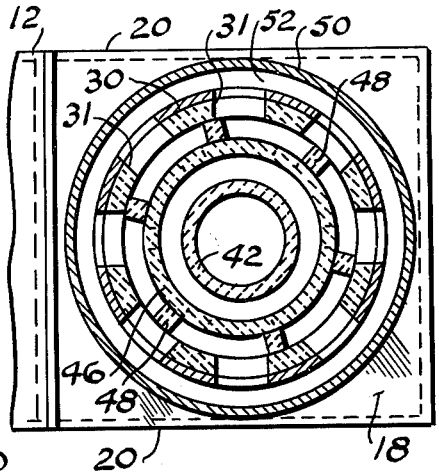
Figure 4:
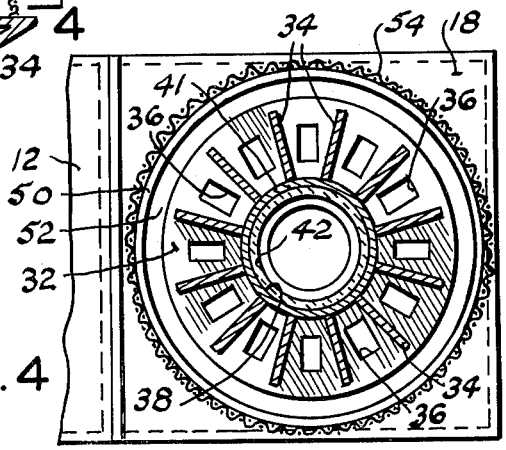

Like characters of reference designate like parts in those figures of the drawings in which they occur.

In the drawings:

The reference numeral 10 indicates the uppermost end portion of a smoke stack or flue having its upward normally open end closed by a cap or cover 12 and provided with a lateral opening 14 adjacent its upper end. The opening 14 is surrounded by and communicates with a lateral flue chamber 16 formed by a horizontal ledge 18, opposing side walls 20 and an upwardly inclined wall 22.

The numeral 24 indicates the incinerator, as a whole, comprising an upright elongated casing, cylindrical in general configuration, having a combustion chamber 26 in its depending end portion defined by a high temperature resistant refractory material wall 28 contiguously contacting the inner surface of the casing wall 30. The casing wall 30 and refractory wall 28 are provided with cooperating circumferentially and vertically spaced air admitting openings 31 for the purposes presently explained. The depending end of the casing wall 30 is partially closed by a bottom wall 32 which overlies the ledge 18 in vertically spaced relation and is supported by a plurality of gussets 34 radially disposed edgewise between the positions of a like plurality of apertures 36 formed through the casing bottom wall 32. The casing bottom wall 32 and ledge 18 are centrally provided with vertically aligned apertures 38 and 40, respectively, joined by an annular flange 41 which cooperatively receives a cylindrical-like bushing 42 formed from high temperature resistant refractory material. The bushing 42 slightly converges upwardly and extends from the depending limit of the ledge 18 to a point intermediate the vertical extent of the refractory wall 28.

An inverted, generally U-shaped in cross section, deflector or baffle 44, having a horizontal bight portion 45 and being formed from high temperature resistant refractory material, concentrically overlies in loosely surrounding relation the upper end portion of the bushing 42 with the depending end of the bushing wall 46 being supported by a plurality of radially spaced vanes 48. The vanes 48 are generally rectangular being similarly formed of refractory material and overlying the position of a like plurality of the gussets 34. One vertical edge surface, of each vane 48, contacts the adjacent inner vertical surface of the refractory wall 28 while its opposite vertical edge surface is disposed in spaced-apart relation with respect to the adjacent outer surface of the bushing 42. The area containing the vanes 48, namely between the perimeter of the bushing 42, inner surface of the refractory wall 28 and between the upper surface of the bottom wall 32 and depending limit of the baffle 44, forms an annular expansion zone in which the heated gases are homogeneously mixed with additional combustion air.

A downwardly open sleeve 50 loosely surrounds the depending end portion of the casing 24 to form an annular air chamber 52. The sleeve 50 extends upwardly from the plane of the bottom wall 32 a distance at least coextensive with the casing and refractory wall openings 31 and is connected, at its upper end as by welding, to the periphery of the casing 24. A safety screen 54 circumferentially surrounds the depending end portion of the sleeve 50 and is supported by the upper surface of the ledge 18 to prevent objects being drawn into the air chamber 52 by the draft generated by combustion as presently explained.

Burner means 56 is mounted within the lateral flue chamber 16 and is supplied with a source of fuel by a pipe 58. The upper end portion of the casing 25 is provided with a fly ash trap 60 comprising a metallic frame 62 loosely surrounding and projecting above the upper end portion of the casing which is covered by screen material 64.

OPERATION

In operation, the incinerator 24 is installed, as described hereinabove. Obviously, the incinerator 24 may be used as an afterburner for other waste material burning devices, if desired. Smoke containing unburned hydrocarbons from the flue 10 entering the lateral chamber 16 flows upwardly through the bushing 42 while being heated by the burner means 56 and is directed downwardly in a settling action by the baffle 44, in the direction of the arrows, into contact with the refractory vanes 48 and wall 28 while being supplemented by air entering the combustion chamber through the bottom wall apertures 36 and side wall openings 31. When the refractory material, including the bushing 42, baffle 44 and wall 28, has been heated to a combustion temperature, the combustion is self-generating and fuel to the burner means 56 may be discontinued or at least reduced to a minimum. The relative sizes and arrangement of the bushing, baffle, casing and casing apertures 31 generates a Venturi effect through the combustion chamber 26. After passing through the combustion chamber 26 the burned gases are exhausted to the atmosphere through the screen cap 60. As an example of the efficiency of the incinerator 24, we have found that the normally black smoke discharged by a conventional incinerator, burning discarded vehicle tires, when entrained through our incinerator is discharged as exhaust gases slightly gray in color, as viewed by the naked eye.

Obviously the invention is susceptible to changes or alterations without defeating its practicability, therefore, we do not wish to be confined to the preferred embodiment shown in the drawings and described herein.

We claim:

1. An apparatus for oxidizing residual combustible hydrocarbons in a flue gas stream, comprising:

an upright casing having an internal high temperature resistant refractory lined lower end wall portion forming a combustion chamber and having a centrally apertured bottom wall defining the lower limit of the combustion chamber;

flue gas inlet means including a centrally apertured horizontally disposed ledge underlying said casing in supporting relation and walls depending from said ledge for forming a flue gas chamber communicating with the combustion chamber;

burner means in the flue gas chamber;

an inner tubular bushing of high temperature resistant refractory material coaxial with the casing bottom wall aperture and spaced inwardly of the combustion chamber refractory wall to define an annular expansion zone therebetween;

baffle means overlying said inner tubular bushing to cause initial settling and downward flow of gases and entrained particulate matter, said baffle means including an inverted generally U-shaped in transverse section member formed from high temperature resistant refractory material loosely surrounding the upper end portion of said bushing, and, a plurality of vertically disposed circumferentially spaced refractory material vanes interposed between said bottom wall and said inverted member for supporting the latter;

and, means for introducing excess combustion air into the expansion zone and its downstream end portion including a plurality of circumferentially spaced-apart radial gussets interposed between said horizontal ledge and the depending surface of said bottom wall, said bottom wall having a like plurality of circumferentially spaced apertures, the apertures being respectively disposed between the position of said gussets, and a sleeve coextensive with the combustion chamber and loosely surrounding the depending end portion of said casing and forming a downwardly open excess combustion air chamber, said refractory wall portion and the depending end portion of said casing having a plurality of cooperating circumferentially and vertically spaced openings extending horizontally therethrough.

2. The apparatus according to claim 1 and further including:

screen cap means surrounding the upper end portion of said casing.

* * * * *